US010743113B2

(12) United States Patent
Segota et al.

(10) Patent No.: US 10,743,113 B2
(45) Date of Patent: Aug. 11, 2020

(54) MICROPHONE AND METHODS OF ASSEMBLING MICROPHONES

(71) Applicant: Shure Acquisition Holdings, Inc., Niles, IL (US)

(72) Inventors: Jeff Segota, Niles, IL (US); Michael Alwicker, Chicago, IL (US); Daniel Pratt, Niles, IL (US); John Miller, Grayslake, IL (US); Elizabeth Cho, Wilmette, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/528,880

(22) Filed: Aug. 1, 2019

(65) Prior Publication Data

US 2019/0356988 A1 Nov. 21, 2019

Related U.S. Application Data

(63) Continuation of application No. 15/235,382, filed on Aug. 12, 2016, now Pat. No. 10,412,503.

(51) Int. Cl.
*H04R 19/00* (2006.01)
*H04R 19/04* (2006.01)
(Continued)

(52) U.S. Cl.
CPC ..... *H04R 19/04* (2013.01); *H04R 1/04* (2013.01); *H04R 1/086* (2013.01); *H04R 19/005* (2013.01);
(Continued)

(58) Field of Classification Search
CPC . H04R 1/04; H04R 1/08; H04R 1/083; H04R 1/086; H04R 1/2807; H04R 1/326; H04R 19/04; H04R 19/016
See application file for complete search history.

(56) References Cited

U.S. PATENT DOCUMENTS 5,329,593 A * 7/1994 Lazzeroni ..... H04R 1/38 181/158
7,106,869 B2 9/2006 Kanda et al.
(Continued)

FOREIGN PATENT DOCUMENTS

CN 103248972 A 8/2013
CN 103313174 A 9/2013

OTHER PUBLICATIONS

Feb. 21, 2019—(WO) International Preliminary Report on Patentability—App PCT/US2017/046146.
(Continued)

*Primary Examiner* — Matthew A Eason
(74) *Attorney, Agent, or Firm* — Banner & Witcoff, Ltd.

(57) ABSTRACT

A microphone can include a cover having a series of slits and a nest. The nest can be configured to receive a first diaphragm, a second diaphragm, and a PCB in a stacked arrangement, such that the PCB is positioned between the first diaphragm and the second diaphragm. Also the first diaphragm can define a first plane, the second diaphragm can define a second plane, and the PCB can define a third plane and the first plane, the second plane, and the third plane can extend parallel to one another. The cover can also include slits having a first length and a second length, and the first length can be greater than the second length. The slits can extend both radially and axially.

24 Claims, 8 Drawing Sheets

(51) Int. Cl.

| | |
|---|---|
| ***H04R 1/04*** | (2006.01) |
| ***H04R 1/08*** | (2006.01) |
| ***H04R 19/01*** | (2006.01) |
| *H04R 1/28* | (2006.01) |
| *H04R 1/40* | (2006.01) |

(52) U.S. Cl.
CPC ..... *H04R 19/016* (2013.01); *H04R 1/083* (2013.01); *H04R 1/2807* (2013.01); *H04R 1/406* (2013.01); *H04R 2410/03* (2013.01)

(56) References Cited

U.S. PATENT DOCUMENTS

2004/0005070 A1* 1/2004 Kanda ..... H04R 19/04 381/369
2006/0251274 A1* 11/2006 Akino ..... H04R 1/04 381/111
2010/0135514 A1 6/2010 Hinke
2010/0296674 A1* 11/2010 Statham ..... H04R 3/005 381/119
2013/0044899 A1* 2/2013 Barber ..... H04R 19/016 381/113
2014/0001580 A1* 1/2014 Bolognia ..... B81C 1/00333 257/416
2014/0376761 A1* 12/2014 Godfrey ..... H04R 1/04 381/356
2015/0003645 A1* 1/2015 Akino ..... H04R 19/04 381/174
2015/0010165 A1* 1/2015 Peng ..... H04R 3/02 381/93
2015/0098592 A1 4/2015 Akino

OTHER PUBLICATIONS

Jensen, Mads Herring, MEMS Microphone Model Presented at ASA 166 in San Francisco, COMSOL Blog, Jan. 2, 2014, retrieved online at: <<https:/fwww_comsol.com/blogs/mems-microphone-model-presented-asa-166-san-francisco/>>.
Jan. 3, 2018—(WO) Written Opinion and International Search Authority—App PCT/US2017/046146.
Bruel & Kjaer 4938—1/4-inch pressure-field microphone, 4Hz to 70kHz, 200v polarization—Jul. 22, 2016.
Dec. 11, 2019—(EP) Office Action—Appl No. 17754951.6.
Dec. 3, 2019—(CN) Office Action—Appln No. 201780057835.2.

* cited by examiner

MICROPHONE AND METHODS OF ASSEMBLING MICROPHONES

PRIORITY

This application is a continuation of U.S. patent application Ser. No. 15/235,382 entitled "Microphone and Methods of Assembling Microphones" and filed on Aug. 12, 2016 which is incorporated by reference herein in its entirety.

FIELD OF THE INVENTION

The present disclosure relates generally to microphones, and more particularly to small microphones that may be configured as, for example, lavalier, lapel, earset, headset, or instrument microphones. These types of microphones can be worn by or attached to the user or instrument and can in certain examples be condenser microphones or electret condenser microphones.

BACKGROUND

Condenser microphones operate by use of a capacitor, which generally consists of two plates and a voltage between them. One of the plates of the capacitor can be formed of a lighter material, such that it acts as a diaphragm, which vibrates as it encounters sound waves. This changes the distance between the two plates and alters the capacitance. In particular, when the plates are nearer to each other, the capacitance increases inducing a charge current and when the plates are spaced farther apart, the capacitance decreases causing a discharge current. Electret condenser microphones can utilize a ferroelectric material or a permanently electrically charged or polarized material.

Condenser microphones and specifically electret condenser microphones can be used in conjunction with lavalier, lapel, earset, headset, or instrument microphones and other hands-free operation microphones. Lavalier or lapel microphones, sometimes referred to as body microphones, collar microphones, clip microphones, neck microphones or personal microphones, are often used in theatre, musical, television, public speaking, and other environments that require movement of the performer or hands free operation. These types of microphones can be provided with clips to permit attachment to various clothing, e.g., shirts, collars, ties, etc. to allow for a hands-free operation. In certain examples, the cords can be hidden underneath clothing and can be connected directly to a mixer or other recording device or can be connected to a body pack receiver worn on the user, which can transmit a signal to a mixer or other recording device.

SUMMARY

This Summary provides an introduction to some general concepts relating to this disclosure in a simplified form that are further described below in the Detailed Description. This Summary is not intended to identify key features or essential features of the invention.

Aspects of the disclosure herein may relate to a smaller, high fidelity microphone that is easy to conceal. In one example, a microphone can include a cover having a series of slits and a nest. The nest can be configured to receive a first diaphragm, a second diaphragm, and a PCB in a stacked arrangement, such that the PCB is positioned between the first diaphragm and the second diaphragm. In one example, the first diaphragm can define a first plane, the second diaphragm can define a second plane, and the PCB can define a third plane. The first plane, the second plane, and the third plane can extend parallel to one another in the nest. The cover can also include slits having a first length and a second length, and the first length can be greater than the second length. The slits can extend both radially and axially.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
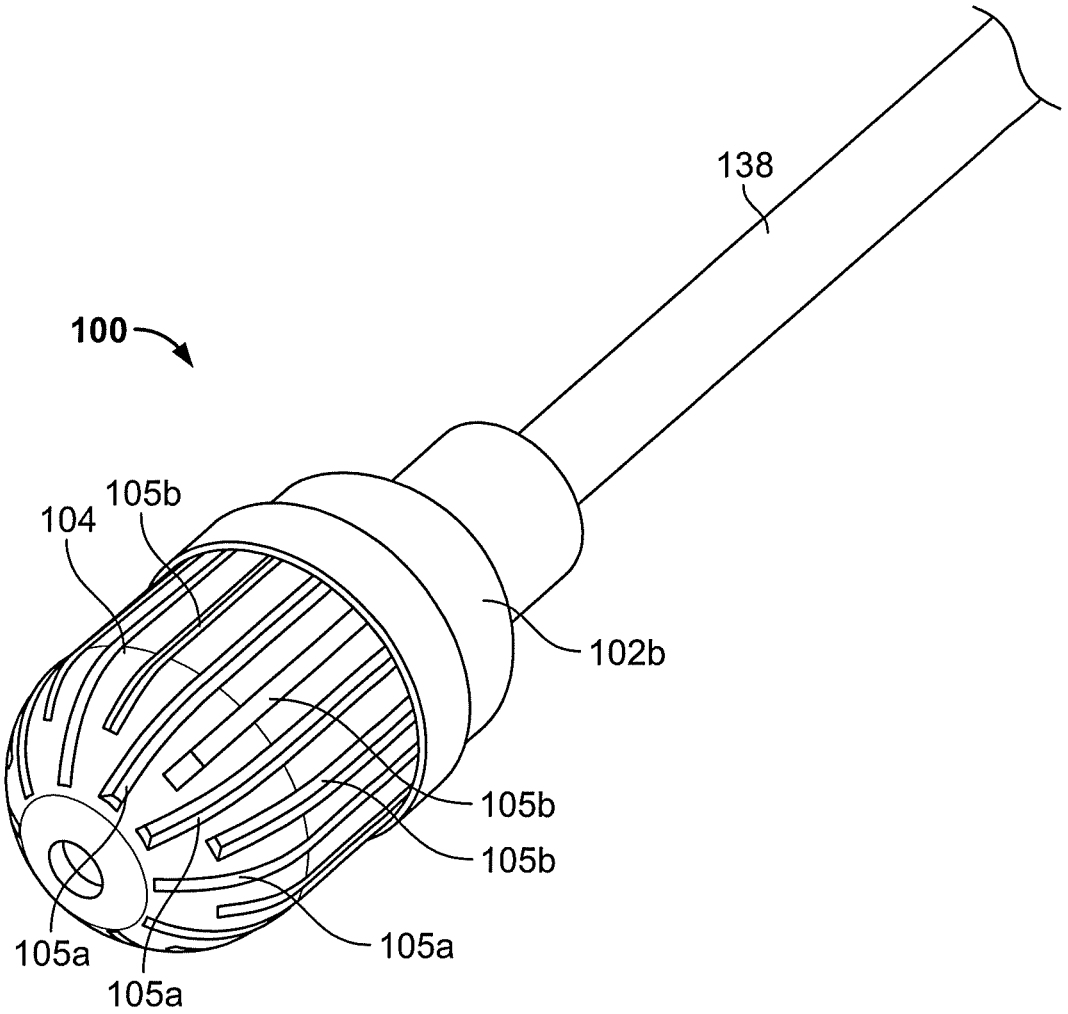
FIG. 1 shows a perspective view of an example condenser microphone.

FIG. 1 shows an example lapel microphone 100, which in one example can be an electret condenser microphone. The lapel microphone 100 generally includes a cartridge 102 and a cover 104. In one example, the cartridge, when assembled, can have a length that is 9 mm or less and a diameter of 4.5 mm.

Although not shown, the lapel microphone 100 can be provided with a clip that can have elastic properties for securing the lapel microphone to a user's clothing. Although the example herein is shown as a lapel microphone, it is contemplated that the microphone could be configured as an earset or headset microphone and as any other hands-free operation microphone.

Figure 2:
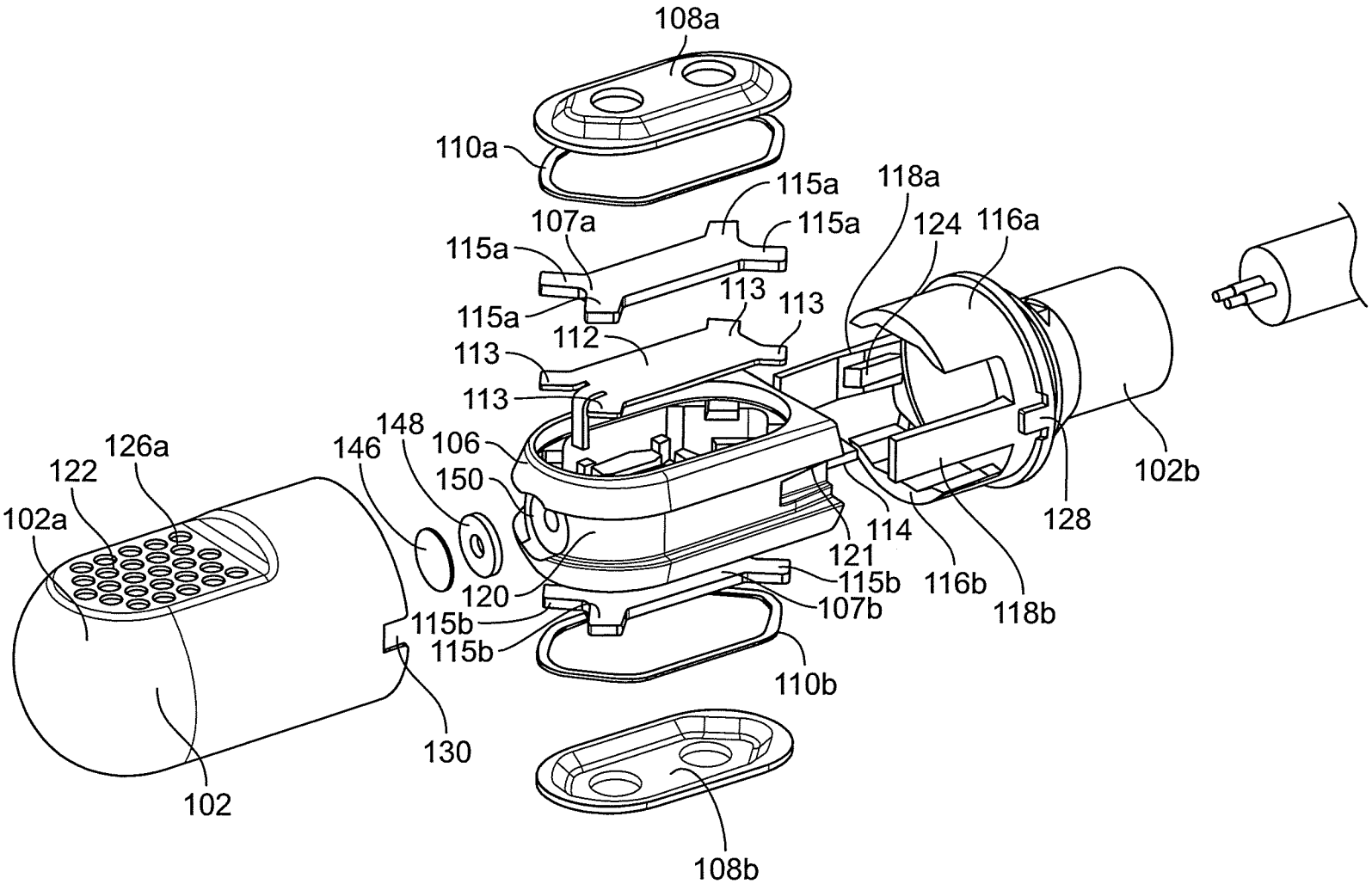
FIG. 2 shows an exploded view of an example condenser microphone.
Figure 2A:
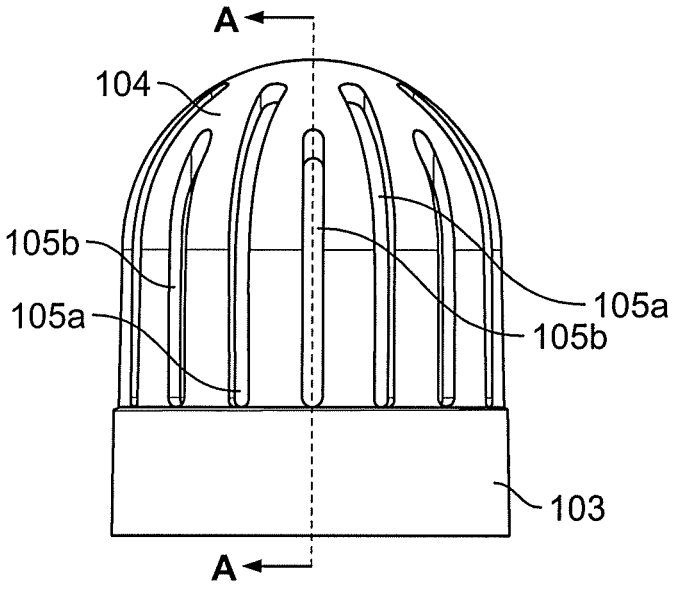
FIG. 2A shows a front view of an example cover for the condenser microphone of FIG. 1.
Figure 2B:
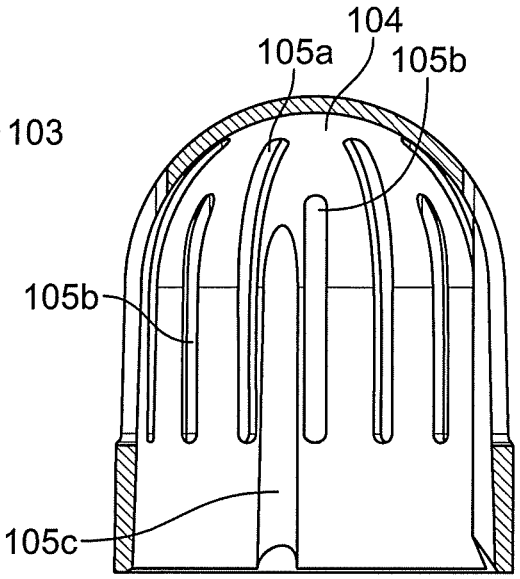
FIG. 2B shows a cross-section view of the example cover of FIG. 1A along line A-A of FIG. 2A.
Figure 2C:
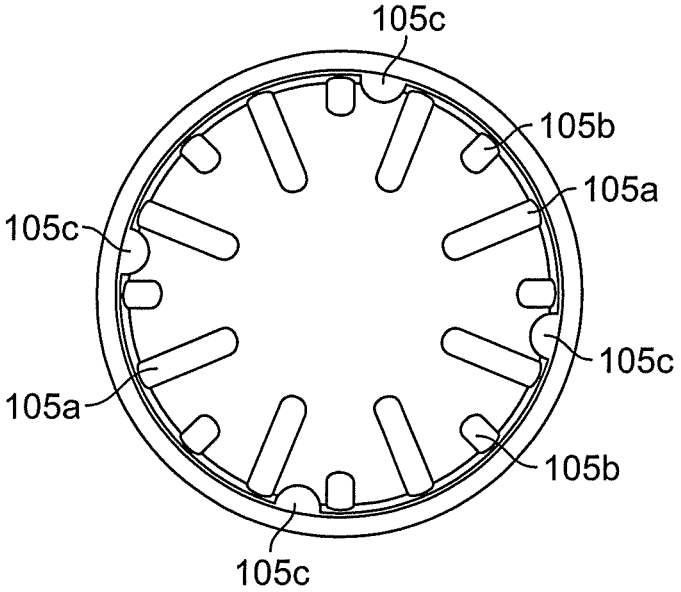
FIG. 2C shows a top view of the example cover of FIG. 2A.

FIG. 2 shows an exploded view of the example lapel microphone 100 with the cover 104 removed. A nest or housing 106 can be included within the cartridge 102 for receiving the individual components that are used to convert sound waves into electrical signals as discussed herein. Specifically, the nest 106 can be configured to house a first diaphragm 108*a*, a second diaphragm 108*b*, a first washer 110*a*, a second washer 110*b*, a first back plate 107*a*, a second back plate 107*b*, a contact spacer 112, and a PCB 114. The nest 106 can also include a front washer 148 and a front disk 146.

During operation of the lapel microphone 100, the potential of the back plates 107*a*, 107*b* is changed in accordance with the vibration of the diaphragms 108*a*, 108*b*. Specifically, sound travels through slits 105*a*, 105*b* in the cover and interacts with the diaphragms 108*a*, 108*b* causing the diaphragms 108*a*, 108*b* to oscillate to cause the capacitance to change between the diaphragms 108*a*, 108*b* and the back plates 107*a*, 107*b*. The change in the capacitance from the back plate 107*a* and the diaphragm 108*a* is then outputted from the back plate 107*a* to the contact spacer 112, which outputs the potential change to the PCB 114. Also the change in the capacitance from the diaphragm 108*b* and back plate 107*b* is outputted directly to the PCB 114. The PCB 114 can be configured to create an output based on the signals received from the contact spacer 112 and the back plate 107*b* through the cable 138 from the microphone 100. The cartridge 102 can be formed of a cap 102*a* and a plug 102*b*. The plug 102*b* can be configured to fit within the cap 102*a* to secure the nest 106 within the cartridge 102.

The plug 102*b* can include several radially extending flanges 116*a*, 116*b*, 118*a*, 118*b* that are configured to align with and engage various slots in the cap 102*a* and the nest 106. In particular, the plug 102*b* includes an upper flange 116*a* and a lower flange 116*b* that fits within corresponding upper and lower slots in the cap 102*a*. Also the plug 102*b* includes a first side flange 118*a* and a second side flange 118*b* that are configured to engage a groove or channel 120 located in the nest 106. The channel 120 of the nest 106 may also include cutouts 121 that are configured to receive projections 124 located on the first side flange 118*a* and the second side flange 118*b*. In this way, the projections 124 act as detents that are received in the cutouts 121 to form a snap-fit type connection. The radially extending flanges 116*a*, 116*b*, 118*a*, 118*b* can also shield the rear portion of the nest 106. In one example, the plug is formed of a suitable metal material and the nest is formed of a polymer material such that the flanges 116*a*, 116*b*, 118*a*, 118*b* shield the polymeric material of the nest 106. The radially extending flanges 116*a*, 116*b*, 118*a*, 118*b* also help to reduce the number of components needed to form the cartridge in that there does not need to be an additional component to interface between the plug 102*b* and the nest 106.

The plug 102*b* may also include surface flanges 128 that are configured to be received into corresponding surface openings 130 located in the cap 102*a*, and the cap 102*a* and the plug can be welded together to assemble the microphone. However, in other examples the cap 102*a* and the plug 102*b* can form a snap-fit or friction-fit to secure the cap 102*a* and the plug 102*b*.

The cap 102*a* can include an upper flat surface 126*a* and a lower flat surface (not shown). The volume between the cover 104 and upper flat surface 126*a* and the volume between the lower surface and the cover can be sized to optimize the acoustic properties of the microphone. The upper flat surface 126*a* and the lower flat surface can include a series of holes 122 to internally open the cap 102*a* to the first diaphragm 108*a* and the second diaphragm 108*b*. The holes 122 are, thus, configured to receive sound waves, which interact with the first diaphragm 108*a* and the second diaphragm 108*b*.

As shown in FIGS. 1, 2A-2C, the cover 104 can be formed of a cylindrical-hemispherical shape, where an end is formed of a hemispherical shape. The cover 104 generally forms a volume of air, which can be referred to as a tube. The cover 104 generally includes a series of slits 105*a*, 105*b* configured as acoustic openings that extend axially and radially along the cover 104 thereby controlling the volume of air within the tube. The slits 105*a*, 105*b* can be configured such that sound waves can travel through the cover 104 and into the microphone 100 to vibrate the diaphragms 108*a*, 108*b*.

In one example, the slits 105*a*, 105*b* can alternate in axial and radial length along the cover. The length of the slits 105*a*, 105*b* changes the acoustic properties of the microphone by determining how many holes in the underlying cartridge 102 are exposed and controlling the volume of air that is exposed. In particular, the slits 105*a* can extend to a first axial and radial length that is longer than a second axial and radial length of the slits 105*b*. In addition the slits 105*a*, 105*b* can curve inward toward the top of the cover in the axial and radial direction. It is also contemplated that the series of slits 105*a*, 105*b* can extend to the same axial and radial length and the axial and radial lengths of the slits can be adjusted according to the desired acoustic properties of the microphone.

The cover 104 may also include a cylindrical rim 103 that is configured to engage the cap 102*a*. In this example, the cylindrical rim 103 can be maintained on the cap 102*a* by way of a friction or interference fit. Additionally, the cover 104 can be provided with a series of projections 109, which extend radially inward, to allow the cover 104 to frictionally engage the cap 102*a* to secure the cover 104 to the cap 102*a*. In this way, the cover 104 can be held onto the cap 102*a* during use and may also be removed to use a different cover, such as cover 204 discussed below.

The slits 105*a*, 105*b* can define a slit area, and the cylindrical rim 103 can define a cylindrical rim area. In one example, the cylindrical rim area can longer in the axial direction than the cylindrical rim area. In one example, the cover 104 can be molded by a suitable injection molding process from a polymeric material, such as an injection molding grade of acrylonitrile butadiene styrene ("ABS"), for example, ABS-LUSTRAN® 348 and other like materials. However, in other examples, the cover 104 can be formed of a metal or various metal alloys.

Figure 2D:
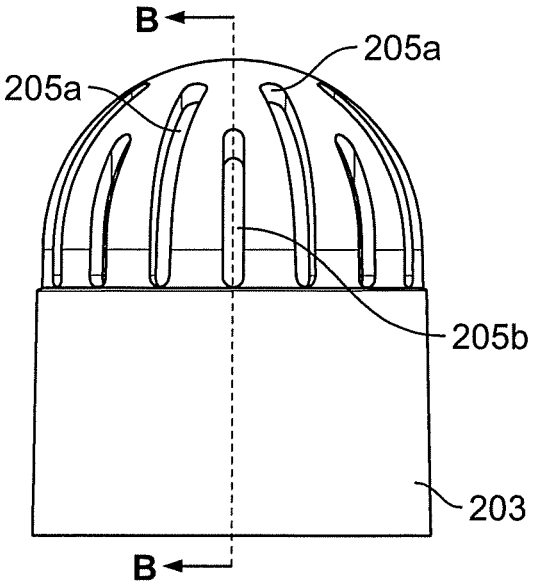
FIG. 2D shows a side view of another example cover.
Figure 2E:
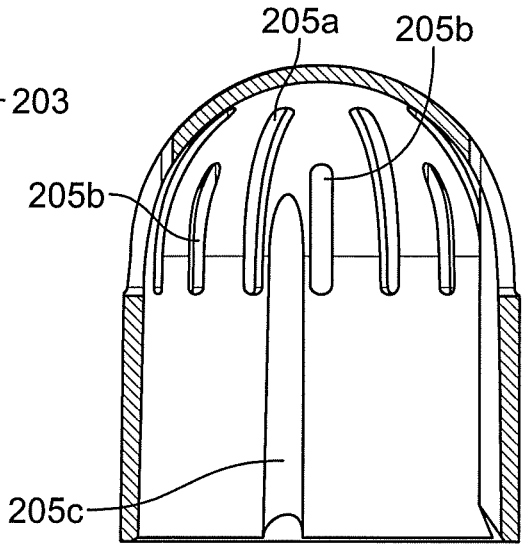
FIG. 2E shows a cross-section view of the cover of 2D along line B-B of FIG. 2D.
Figure 2F:
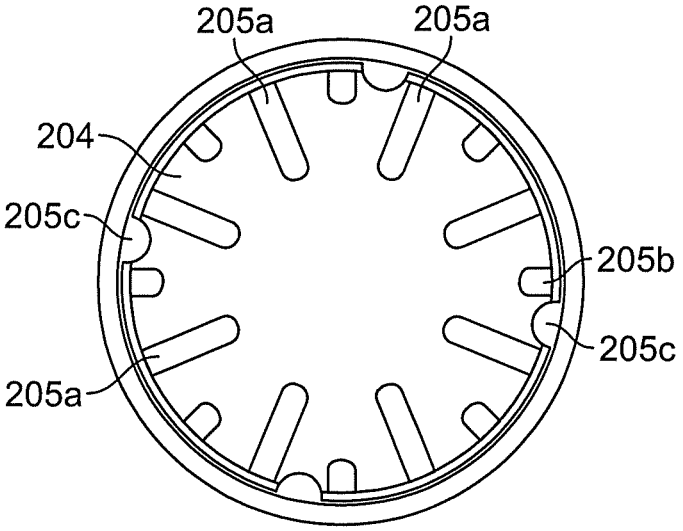
FIG. 2F shows a top view of the example cover of FIG. 2C.

FIGS. 2D-2F show another exemplary cover 204, in which like reference numerals refer to the same or similar elements as cover 104 discussed above. The cover 204 may also be formed of a cylindrical-hemispherical shape, where an end is formed of a hemispherical shape. However, the slits 205*a*, 205*b* can be shorter than the slits 105*a*, 105*b* to provide varying acoustic properties. Also, the cylindrical rim 203 can be formed larger in the axial direction than the cylindrical rim 103 for engaging the cap 102*a*. Also, the slit area can be formed of a similar axial length as the axial length of cylindrical rim area.

Like in the above example, the cover 204 generally forms a volume of air or a tube. The slits 205*a*, 205*b* can also be configured as acoustic openings that extend axially and radially along the cover 204 thereby controlling the volume of air within the tube and can be configured such that sound waves can travel through the cover 204 and into the microphone 100 to vibrate the diaphragms 108*a*, 108*b*.

In one example, the frequency response with cap 204 can have a more high end response than cap 104. In this example, the high frequencies can be accentuated in cap 204 relative to the cap 104. Also the cap 104 can have a flatter frequency response relative to cap 204. Moreover, the cap 204 can boost the high frequencies relative to the cap 104. In this way both covers 104, 204 can be provided in a microphone kit with the cartridge 102, such that the user can select the most suitable cover for the particular application. It is also contemplated that instead of covers 104, 204 a simple sleeve could be used for covering the cartridge. The sleeve can be a mesh or foam sleeve. The alternative sleeve or sleeves could also be provided in the microphone kit.

Also in this example, the slits 205*a*, 205*b* can alternate in axial and radial length along the cover. The length of the slits 205*a*, 205*b* changes the acoustic properties of the microphone by determining how many holes in the underlying cartridge 102 are exposed and controlling the volume of air that is exposed. Again, it is also contemplated that the series of slits can extend to the same axial and radial length, and the axial and radial lengths of the slits can be adjusted according to the desired acoustic properties of the microphone. The cover 204 may also be molded by a suitable injection molding process from a polymeric material as discussed above.

Figure 3A:
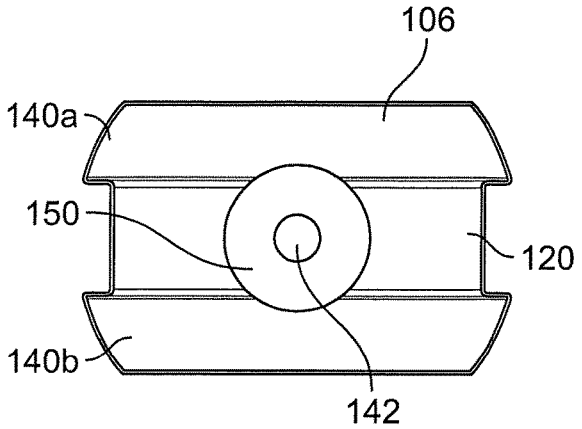
FIG. 3A shows a front view of an example nest for a condenser microphone.
Figure 3B:
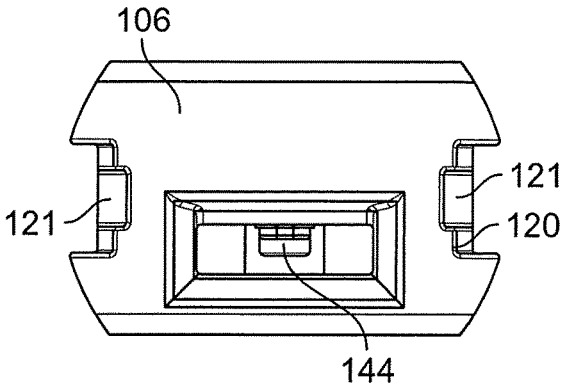
FIG. 3B shows a rear view of the example nest of FIG. 3A.
Figure 3C:
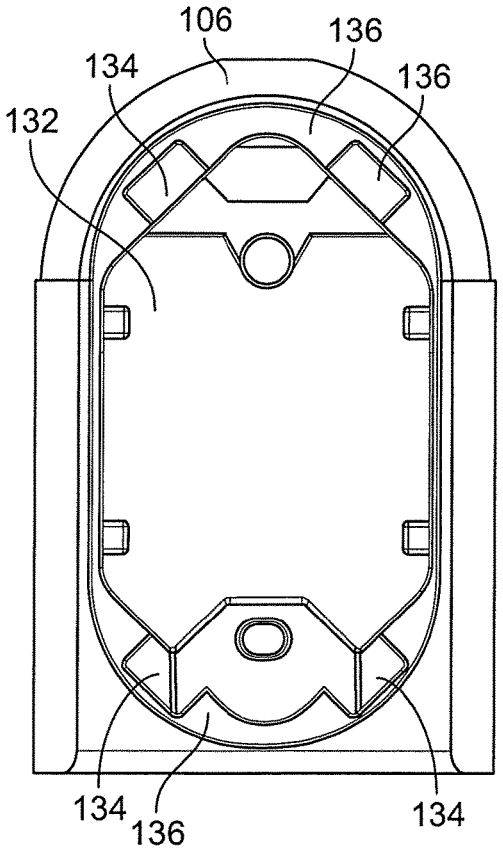
FIG. 3C shows a top view of the example nest of FIG. 3A.
Figure 3D:
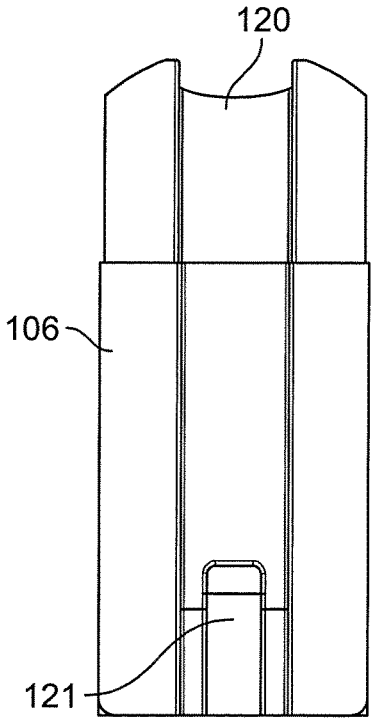
FIG. 3D shows a side view of the example nest of FIG. 3A.

The nest 106 is shown in FIGS. 2 and 3A-3D. As shown in FIG. 2, the nest 106 can be generally sized to fit within the cartridge 102. As shown in FIG. 3C, which is a top view of the nest 106, the nest 106 can have a curved front end and a flat back end. The curved profile can accommodate the curved profile of the cap 102*a* and cover 104. The flat back end can be configured to accommodate the plug 102B of the capsule 102 such that the nest 106 can be secured within the plug 102*b*.

As shown in FIGS. 3A and 3B, the nest 106 can include a tapered upper portion 140*a* and a tapered lower portion 140*b* to conform with the cartridge 102. The tapered upper portion 140*a* and the tapered lower portion 140*b* allow the nest to conform with the curvature and shape of the capsule 102 and the cover 104. The area between the tapered upper portion 140*a* and the tapered lower portion 140*b* creates a channel 120 that is configured to receive the side flanges 118*b*, 118*a* of the plug 102*b*. In one example, the nest 106 can be formed of a liquid crystal polymer, or a glass reinforced liquid crystal polymer. However, other suitable comparable materials are also contemplated.

The nest 106 is a generally hollow structure having an opening 132 that extends through the body of the nest 106. The opening 132 of the nest 106 is configured to receive the internal components of the microphone 100, including the first diaphragm 108*a*, the second diaphragm 108*b*, the first washer 110*a*, the second washer 110*b*, the first back plate 107*a*, the second back plate 107*b*, the contact spacer 112, and the PCB 114. Also, the first diaphragm 108*a*, the second diaphragm 108*b*, the first washer 110*a*, the second washer 110*b*, the first back plate 107*a*, the second back plate 107*b*, the contact spacer 112, and the PCB 114 are arranged in a parallel arrangement in that each define a plane, and each of the planes are configured to extend parallel to one another. Additionally, each of the axes of the first diaphragm 108*a*, the second diaphragm 108*b*, the first washer 110*a*, the second washer 110*b*, the first back plate 107*a*, the second back plate 107*b*, the contact spacer 112, and the PCB 114 extend parallel to the axis of the nest.

In addition, the first diaphragm 108*a*, the second diaphragm 108*b*, the first washer 110*a*, the second washer 110*b*, the first back plate 107*a*, the second back plate 107*b*, the contact spacer 112, and the PCB 114 are arranged in a stacked arrangement relative to and within the nest 106. The stacked arrangement allows for a more compact assembly of the microphone 100. The stacked arrangement can be accomplished by positioning the PCB 114 between the contact spacer 112, the first diaphragm 108*a*, the second diaphragm 108*b*, the first washer 110*a*, the second washer 110*b*, the first back plate 107*a*, and the second back plate 107*b*. Also the contact spacer 112 is configured to be placed into direct electrical contact with the first back plate 107*a*, and the second back plate 107*b* can be placed into direct electrical contact with the PCB 114. With this arrangement, the contact spacer 112 can be configured to transfer the change in capacitance from the back plate 107*a* and transfer the capacitance change to the PCB 114, and the back plate 107*b* can transfer the capacitance change directly to the PCB 114, which then transfers the signal to the cable 138, thereby outputting an electrical signal from the microphone.

As discussed herein, the nest 106 can be provided with a series of projections, slots, notches, cutouts, or holes for receiving the various components of the microphone 100. The opening 132 of the nest 106 can be provided with four notches 134 in each corner sidewall that are configured to receive four corresponding tabs 113 of the contact spacer 112. Notches 134 can also receive the tabs 115*a* of the first back plate 107*a* such that the first back plate 107*a* is placed directly on top of the contact spacer 112 and the flange 152 extends into electrical contact with the PCB 114 and the second back plate 107*b*. Likewise, four additional notches (not shown) are provided in the bottom of the opening of the nest 106 to receive the second back plate tabs 115*b*. The opening 132 of the nest 106 can also be provided with a series of ledges 136 for receiving the washers 110*a*, 110*b* and the diaphragms 108*a*, 108*b*. In one example, the diaphragms 108*a*, 108*b* can be adhered to the nest 106 and the washers 110*a*, 110*b* are held in position against their respective back plates 107*a*, 107*b* by their respective diaphragms 108*a*, 108*b*.

As shown in FIG. 3A, which is a front view of the nest 106, the nest 106 can be provided with a front circular opening 142, which provides for barometric pressure relief, and a chamfered shoulder 150 for receiving the washer 148 and the disk 146. The disk 146 can be formed as a circular plate and can include a small hole at its center for relief of barometric pressure through the front circular opening 142. In other examples, however, the disk 146 can include several holes or can be formed as a screen. Also as shown in FIG. 3B, which is rear view of the nest 106, a rear slot 144 is provided for receiving the PCB 114, such that the PCB is configured to extend from the rear of the nest 106. In this way, a rear portion of the PCB can be electrically coupled with the cable 138 to transmit a signal through the cable.

Figure 4:
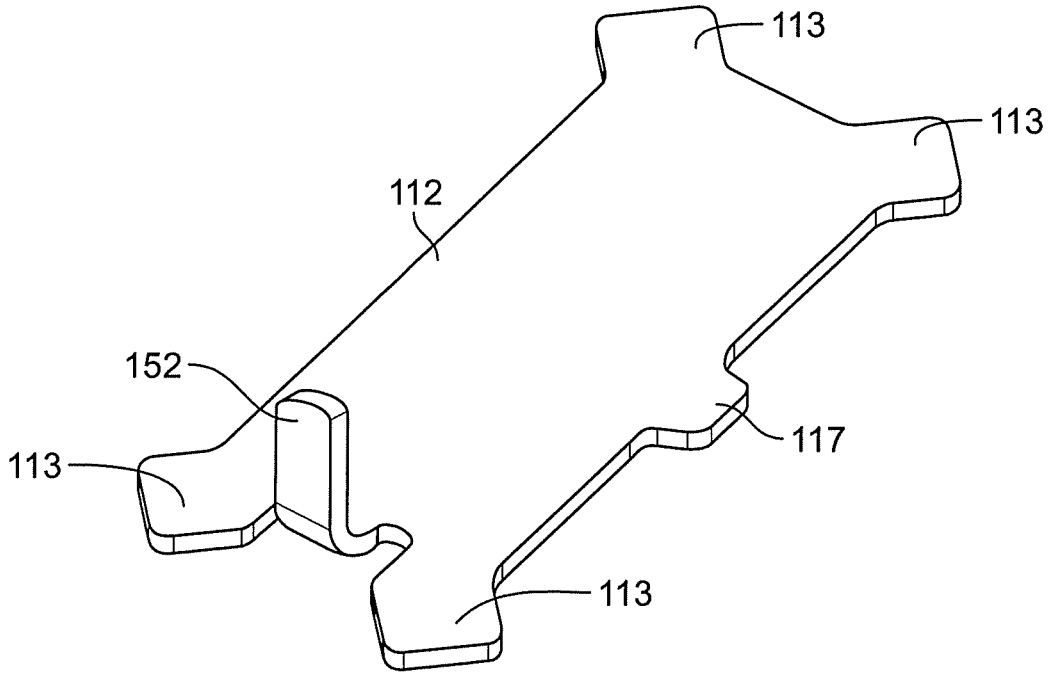
FIG. 4 shows an example contact spacer for a condenser microphone.

FIG. 4 shows a bottom perspective view of the contact spacer 112. The contact spacer can include several tabs 113 for positioning the contact spacer 112 into the nest 106, such that the contact spacer has an appearance of a "dog-bone" shape. The contact spacer 112 can also include a flange 152 extending at a 90° angle with respect to the body of the contact spacer. The flange 152 connects the PCB 114 and the first back plate 107*a* to form an electrical connection between the first back plate 107*a* and the PCB 114. In one example, the flange 152 can be electrically connected to the PCB by way of a conductive epoxy, solder, weld, or like connection. However, the second back plate 107*b* can be directly coupled to the PCB with a conductive epoxy, solder, or weld. The contact spacer 112 can be formed of stainless steel and, in one particular example, the contact spacer 112 can be formed of annealed 316 stainless steel at 0.10 in. thick. In one example, the contact spacer 112 can be formed in a chemical etching process, and an additional tab 117 is provided as part of the formation process.

Additionally, the shape of the contact spacer can be altered to provide differing acoustic properties, for example, rectangular, circular, ovoid, trapezoidal, triangular, and the like, can be used to change the acoustic properties of the microphone. Therefore, it is contemplated that the nest 106 can be manufactured with different contact spacers in order to alter the acoustic properties of the microphone. The next 106 may also be configured to be universal in order to accept different shaped contact spacers to provide different acoustic properties.

Figure 5A:
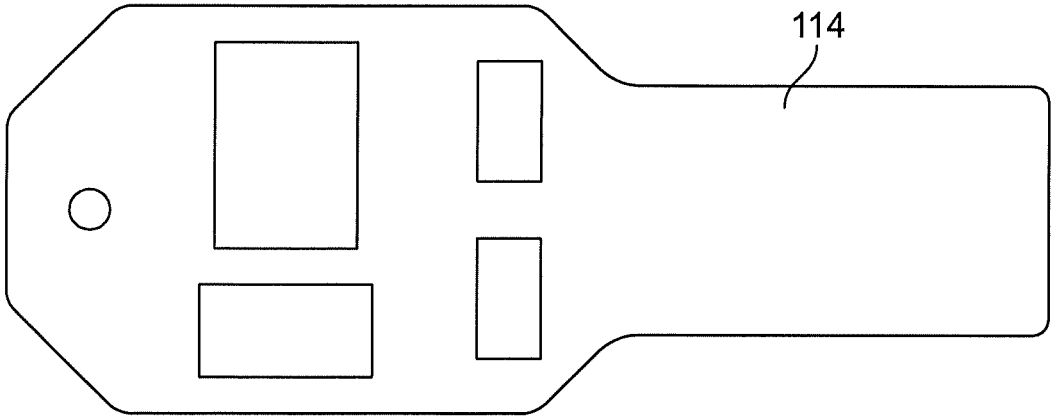
FIG. 5A shows a top view of an example PCB for a condenser microphone.
Figure 5B:
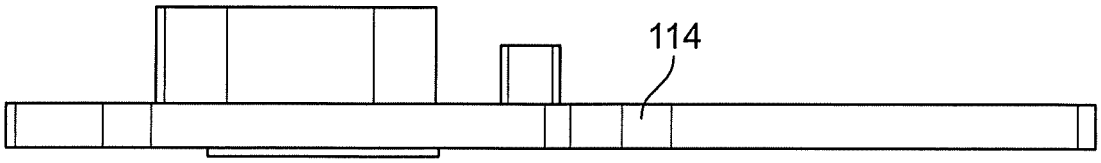
FIG. 5B shows a side view of the example PCB of FIG. 5A.

As shown in FIG. 5, which is a top view of the PCB 114, the PCB 114 can include ten sides to form a decagon. The PCB 114 can be configured to convert the very high electrical impedance of the cartridge to a lower impedance suitable for passing a signal through the cable, attenuate the signal where required, and to filter RF interference. The shape of the PCB 114 can be configured such that it can fit in the assembly while also providing enough area for all of its various components. Therefore, other shapes and configurations of the PCB 114 are also contemplated depending on the desired arrangement.

Figure 6:
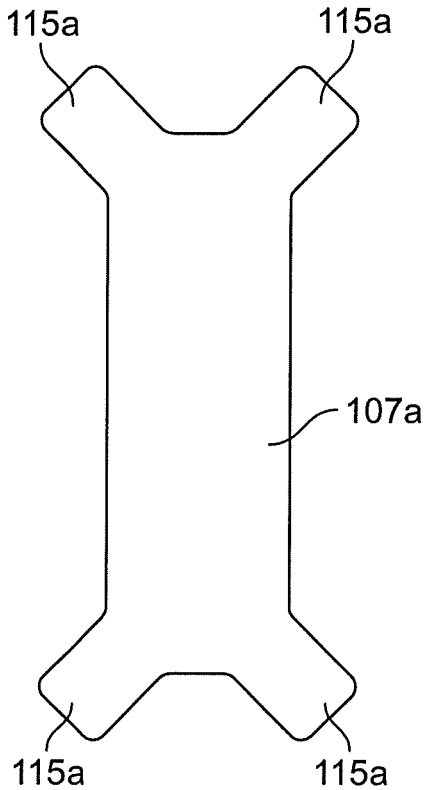
FIG. 6 shows a top view of an example spacer for a condenser microphone.

FIG. 6 shows a top view of the back plate 107*a*. The back plate 107*a* can be provided with a series of back plate tabs 115*a* for aligning the back plate 107*a* with the nest 106. In one example, the back plate 107*a* can include an electret material such that the back plate 107*a* is permanently electrically charged to create an electromotive force. For example, the back plate 107*a* can be formed entirely of the electret material or the electret material can be laminated on a surface that faces the diaphragm 108*a*. In one example, the electret material can be a fluorine resin such as, polytetrafluoroethylene (PTFE) or Teflon®. However, it is also contemplated that a film electret can be adhered to the diaphragm to generate the electromotive force, and the back plate 107*a* can be formed of a simple metal and can be arranged such that it faces the diaphragm.

Back plate 107*b* can be formed identically to back plate 107*a*. The back plates 107*a*, 107*b* can be aligned with the diaphragms and spaced apart from the diaphragms by the washers 110*a*, 110*b* to create two parallel capacitors. Also as discussed herein, the back plates 107*a*, 107*b* can be placed into a parallel arrangement to each other such that they are parallel to the axis of the body of the microphone 100 and the axes of the diaphragms 108*a*, 108*b*.

Figure 7A:
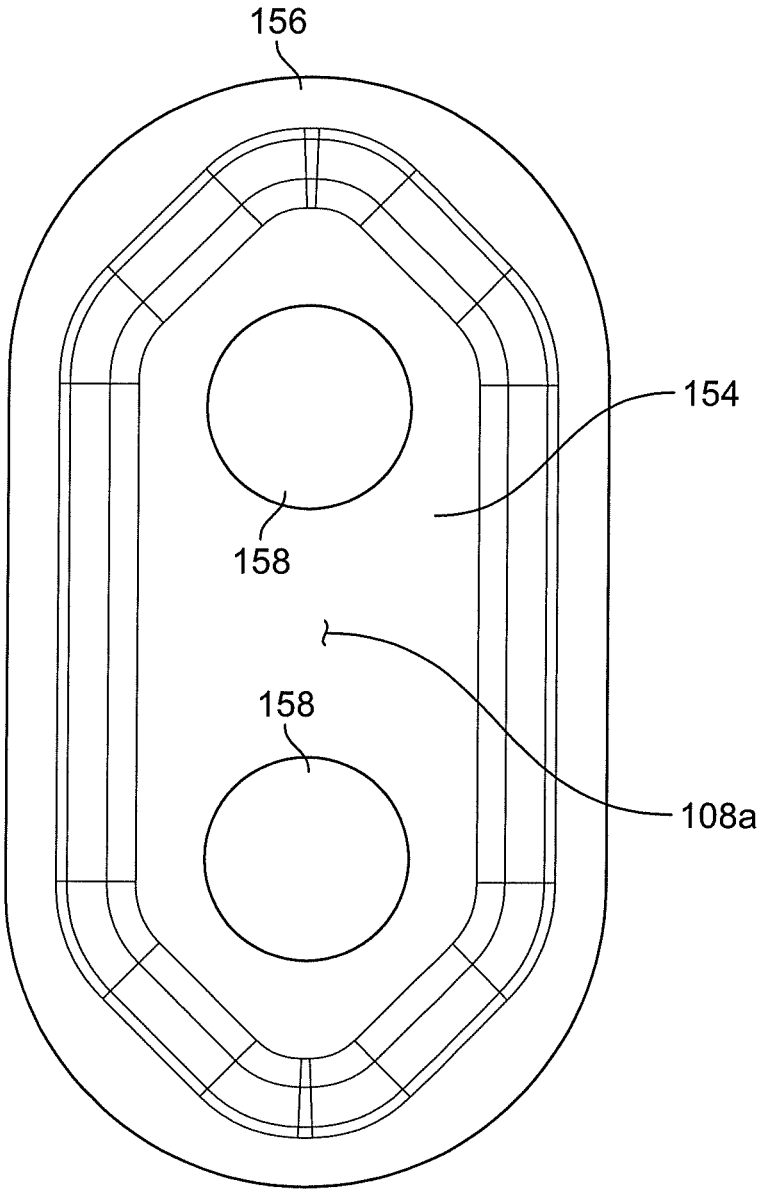
FIG. 7A shows a top view of an example diaphragm for a condenser microphone.
Figure 7B:
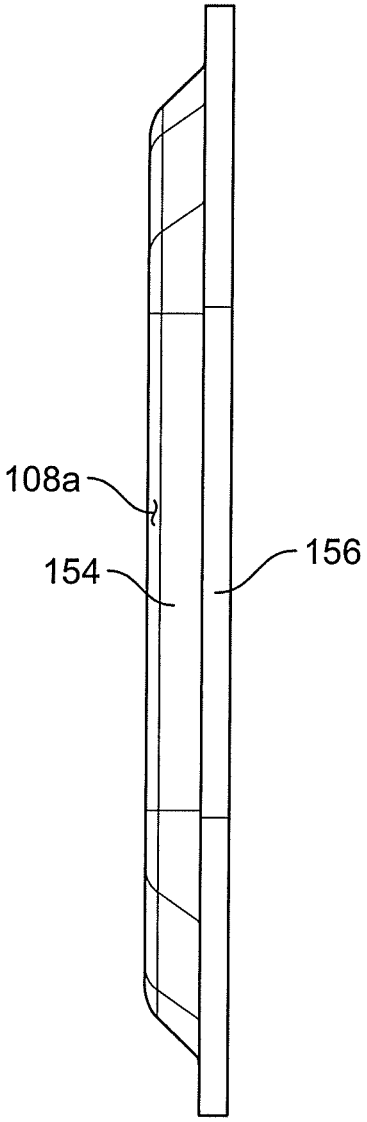
FIG. 7B shows a side view of the example diaphragm of FIG. 7A.

A top view of the exemplary diaphragm is shown in FIG. 7A, and a side view of the exemplary diaphragm of FIG. 7A is shown in FIG. 7B. The diaphragm 108*b* can be formed identically to the diaphragm 108*a*. As shown in FIGS. 7A and 7B, the diaphragm 108*a* includes a diaphragm body 154 and a diaphragm support 156. The diaphragm body 154 can be provided with two sound penetration holes 158 for receiving sound waves from the slits 105*a*, 105*b* in the cover 104. The diaphragm support can be gold plated or plated with any suitable material for providing a suitable capacitor. In one example, the diaphragm body 154 is bonded to the diaphragm support 156 by an adhesive. However, in other examples the diaphragm body 154 and the diaphragm support 156 can be integrally molded together in an injection molding operation, for example.

In one example, the diaphragms 108*a*, 108*b* can be formed into an elongated oval shape or elliptical shape. As discussed above, the diaphragms 108*a*, 108*b* are also placed into a parallel arrangement to each other such that they are parallel to the axis of the body of the microphone 100. Accordingly, the diaphragms 108*a*, 108*b* extend axially along a majority of the body of the microphone. Also the elongated profile of the elliptical diaphragms 108*a*, 108*b* helps to maximize the electrostatic capacity in comparison to a circular shaped diaphragm. However, other shapes of the diaphragms are also contemplated, such as square, rectangular, circular, and the like.

The example microphone discussed herein employs a dual diaphragm structure where two diaphragms 108*a*, 108*b* are used. The inclusion of two diaphragms 108*a*, 108*b* doubles the area and electrostatic capacity thereby increasing the effectiveness of the microphone within a limited space. Also, the diaphragms 108*a*, 108*b* can be positioned such that they oscillate in an opposite phase from one another to assist in canceling mechanical pickup noise such as noise caused by the user inadvertently rubbing the cable. In particular, when the microphone encounters mechanical noise, the microphone is configured to mechanically cancel noises by obtaining a summation signal of the diaphragms vibrating in an opposite phase. This helps to maintain the noise amplified in the microphone at a lower level.

Also the diaphragm body 154 can be set at a particular resonant frequency depending on the desired application of the microphone. In one example, the resonant frequency of the diaphragm 108*a* can be set to 30 to 34 kHz. However, it is contemplated that the diaphragm body 154 can bet set at other resonant frequencies ranging from 20 to 40 kHz.

The washers 110*a*, 110*b* can generally follow the perimeter shape of the diaphragm support 156. The washers 110*a*, 110*b* can be placed between the back plates 107*a*, 107*b* and their respective diaphragms 108*a*, 108*b*. The washers 110*a*, 110*b*, thus, create a spacing between the back plates 107*a*, 107*b* and the diaphragms to form two capacitors. In certain examples, the washers can be formed of various materials, which include, PTFE, PEEK, Polyimide, ETFE and other like materials. It is also contemplated that insulators can be used and that one or more adhesives could be used to replace the washers entirely. Specifically, an adhesive could be applied to either the diaphragms 108*a*, 108*b* or the back plates 107*a*, 107*b* to provide the desired spacing between the diaphragms 108*a*, 108*b* and the back plates 107*a*, 107*b*.

To assemble the microphone 100, the PCB 114 can be placed into the opening of the nest 106 and is secured by an adhesive such that it extends through rear slot 144. The contact spacer 112 is then placed into the opening 132, and the tabs 113 are aligned with and adhered within the notches 134. The back plates 107*a*, 107*b* are then also placed into the opening 132 and their respective tabs are adhered to the notches 134. The washers 110*a*, 110*b* are then adhered to the ledges in the opening 132. Next, the diaphragms are placed over the washers 110*a*, 110*b* and can also be adhered into place on the nest 106. The washer 148 and disk 146 are then placed into the chamfered shoulder of the nest 106 and are secured by a suitable adhesive. In one example, a UV-curable adhesive can be used for securing the various components to the nest 106.

At this point, the assembled nest 106 can then be placed into the plug 102*b* by aligning the side flanges 118*a*, 118*b* with the channel 120 of the nest 106 and the upper and lower flanges 116*a*, 116*b* with the top and bottom of the nest 106. A rear portion of the PCB can be electrically coupled with the cable 138. The plug 102*b* and nest 106 can then be placed into the cap 102*a*, and the plug 102*b* can be secured to the cap 102*a* by suitable welding methods.

In one example, a microphone can include a cover having a series of slits, a cartridge, and a nest configured to be placed within the cartridge. The nest can be configured to receive a first diaphragm, a second diaphragm, and a PCB in a stacked arrangement, such that the PCB is positioned between the first diaphragm and the second diaphragm. The first diaphragm can define a first plane, the second diaphragm can define a second plane, and the PCB can define a third plane. The first plane, the second plane, and the third plane can extend parallel to one another. The cover can include a hemispherical end, and the slits of the cover can have a first length and a second length, and the first length can be greater than the second length. Also the slits can extend both radially and axially. In one example, the microphone can be configured to be secured to a user's clothing The nest can be configured to receive a first washer, a second washer, a first back plate, a second back plate, and a contact spacer. The contact spacer can be placed into direct electrical contact with the first back plate and the PCB and the second back plate is placed into direct electrical contact with the PCB. The nest may also include a first ledge for receiving the first diaphragm and a second ledge for receiving the second diaphragm. The first ledge and the second ledge can include notches for receiving tabs of a first back plate and a second back plate. The cartridge comprises a cap and the cap comprises a series of holes configured to receive sound. In one example, the microphone is an electret condenser microphone.

In another example, a microphone can include a cover having a cylindrical shape and a hemispherical end, and the microphone can be an electret condenser. The microphone can also include a cartridge configured to receive the cover. A nest can be configured to be placed within the cartridge, and the nest can be configured to receive a first diaphragm, a second diaphragm, and a PCB in a stacked arrangement, such that the PCB is positioned between the first diaphragm and the second diaphragm. The first diaphragm can define a first plane, the second diaphragm can define a second plane, and the PCB can define a third plane. The first plane, the second plane, and the third plane can extend parallel to one another.

The cover may include a series of slits, the slits having a first length and a second length, and the first length can be greater than the second length. The slits can extend both radially and axially and alternate between the first length and the second length. The slits can also curve radially inward.

The nest can be further configured to receive a first washer, a second washer, a first back plate, a second back plate, and a contact spacer. The contact spacer can be placed into direct electrical contact with the first back plate and the PCB, and the second back plate can be placed into direct electrical contact with the PCB. The nest can include a first ledge for receiving the first diaphragm and a second ledge for receiving the second diaphragm. The first ledge and the second ledge can include notches for receiving tabs of a first back plate and a second back plate. The nest can include a channel for receiving the cartridge.

In another example, a microphone cover can include a cylindrical shape and a hemispherical end, a series of slits. In one example, the slits can have a first length and a second length, the first length being greater than the second length. The slits can extend both radially and axially and can curve radially inward. The slits can alternate between the first length and the second length. The cover can be configured to receive a microphone cartridge of a lapel microphone. The cover can be formed of a polymeric material, and the polymeric material can be an injection molding grade of acrylonitrile butadiene styrene. The cover may also be formed of a metal or a metal alloy. The cover may also include a cylindrical rim configured to receive a microphone cartridge. The cover can also include a slit area and a cylindrical rim area, and the slit area can be longer in the axial direction than the cylindrical rim area. The cover can include a slit area and a cylindrical rim area, and the cylindrical rim area can be of a similar length in the axial direction as the cylindrical rim area in the axial direction.

In another example, a method of forming a microphone can include providing a nest configured to receive a first diaphragm, a second diaphragm, and a PCB in a stacked arrangement, positioning a PCB between the first diaphragm and the second diaphragm. The first diaphragm may define a first plane, the second diaphragm may define a second plane, and the PCB may define a third plane and the method can include arranging the first diaphragm and the second diaphragm, and the PCB such that the first plane, the second plane, and the third plane extend parallel to one another. The method may also include providing a cover having a cylindrical shape and a hemispherical end and forming the cover with a series of slits, and in one example, the slits can have a first length and a second length. The method may include forming the first length greater than the second length, arranging the slits both radially and axially and alternating the slits between the first length and the second length, placing a first washer, a second washer, a first back plate, a second back plate, and a contact spacer into the nest, placing the contact spacer into direct electrical contact with the first back plate and the PCB, placing the second back plate into direct electrical contact with the PCB.

In another example, a microphone kit can include a cartridge, a first cover and a second cover. Both the first cover and the second cover can include a cylindrical shape and a hemispherical end and a series of slits. The slits can extend both radially and axially and can curve radially inward. The first cover and the second cover can be configured to receive the microphone cartridge. The kit may further include a nest configured to be placed within the cartridge. The nest may include a first diaphragm, a second diaphragm, and a PCB placed in a stacked arrangement, such that the PCB is positioned between the first diaphragm and the second diaphragm. The first diaphragm may define a first plane, the second diaphragm may define a second plane, and the PCB may define a third plane, and the first plane, the second plane, and the third plane may extend parallel to one another. The first cover and the second cover series of slits can have a first length and a second length, and the first length can be greater than the second length. In addition, the length of the cartridge can be 9 mm or less.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A microphone kit comprising:

a cartridge; and a first cover and a second cover, both the first cover and the second cover comprising a cylindrical shape and a hemispherical end, a series of slits, the slits extending both radially and axially and curving radially inward, wherein the first cover and the second cover are configured to receive the cartridge and wherein the slits allow sound to pass through and wherein the slits have an axial length along a longitudinal axis of the first and second covers and have a radial length along a radius of the first and second covers and wherein a top surface of at least one of the slits continuously traverses a first portion of the cylindrical shape and a second portion of the hemispherical end, wherein one of the first cover and the second cover is selectable, in combination with the cartridge, to obtain acoustic characteristics suitable for a desired application.

2. The microphone kit of claim 1 wherein the microphone kit further comprises a nest configured to be placed within the cartridge, the nest including a first diaphragm, a second diaphragm, and a printed circuit board (PCB) placed in a stacked arrangement, such that the PCB is positioned between the first diaphragm and the second diaphragm.

3. The microphone kit of claim 2 wherein the first diaphragm defines a first plane, the second diaphragm defines a second plane, and the PCB defines a third plane and wherein the first plane, the second plane, and the third plane extend substantially parallel to one another.

4. The microphone kit of claim 1 wherein the series of slits of both the first cover and the second cover have first length and a second length and wherein the first length is greater than the second length.

5. The microphone kit of claim 1 wherein a cartridge length of the cartridge is 9 mm or less.

6. The microphone kit of claim 1 wherein, in combination with the cartridge, high frequencies are accentuated with the second cover relative to the first cover in combination with the cartridge.

7. The microphone kit of claim 1 wherein, in combination with the cartridge, the first cover has a flatter frequency response relative to the second cover.

8. The microphone kit of claim 1 wherein, in combination with the cartridge, the second cover boosts high frequencies relative to the first cover.

9. The microphone kit of claim 1, wherein the first cover comprises a cylindrical rim configured to receive the cartridge, wherein the cylindrical rim is configured to be removable from the cartridge, and wherein the first cover is replaceable with the second cover.

10. A microphone comprising:

a cartridge;

a nest configured to be placed within the cartridge, the nest including a first diaphragm, a second diaphragm, and a printed circuit board (PCB) placed in a stacked arrangement, such that the PCB is positioned between the first diaphragm and the second diaphragm; and a cover having a series of elongated slits, wherein the slits extend both radially and axially and curve radially inward, and wherein the slits allow sound to pass through, and wherein a top surface of the slits have an axial length along a longitudinal axis of the cover, and have a radial length along a radius of the cover, and traverse a portion of a front of the cover, wherein the cartridge comprises a cap having an upper flat surface and a lower flat surface and wherein a first volume between the upper flat surface and the cover and a second volume between the lower flat surface and the cover are adjustable to obtain desired acoustic characteristics of the microphone.

11. A microphone kit comprising:

a cartridge; and a first cover and a second cover, both the first cover and the second cover comprising a cylindrical shape and a hemispherical end, a series of slits, the slits extending both radially and axially and curving radially inward, wherein the first cover and the second cover are configured to receive the cartridge and wherein the slits allow sound to pass through and wherein the slits have an axial length along a longitudinal axis of the first and second covers and have a radial length along a radius of the first and second covers and wherein at least one of the slits continuously traverses a first portion of the cylindrical shape and a second portion of the hemispherical end, wherein one of the first cover and the second cover is selectable, in combination with the cartridge, to obtain acoustic characteristics suitable for a desired application.

12. The microphone kit of claim 11 wherein, in combination with the cartridge, high frequencies are accentuated with the second cover relative to the first cover in combination with the cartridge.

13. The microphone kit of claim 11 wherein, in combination with the cartridge, the first cover has a flatter frequency response relative to the second cover.

14. The microphone kit of claim 11 wherein, in combination with the cartridge, the second cover boosts high frequencies relative to the first cover.

15. The microphone kit of claim 11, wherein the first cover comprises a cylindrical rim configured to receive the cartridge, wherein the cylindrical rim is configured to be removable from the cartridge, and wherein the first cover is replaceable with the second cover.

16. A microphone comprising:

a cartridge;

a nest configured to be placed within the cartridge, the nest including a first diaphragm, a second diaphragm, and a printed circuit board (PCB) placed in a stacked arrangement, such that the PCB is positioned between the first diaphragm and the second diaphragm;

a cover having a series of elongated slits, wherein the slits extend both radially and axially and curve radially inward, and wherein the slits allow sound to pass through, and wherein the slits have an axial length along a longitudinal axis of the cover, and have a radial length along a radius of the cover, and traverse a portion of a front of the cover; and wherein the cartridge comprises a cap having an upper flat surface and a lower flat surface and wherein a first volume between the upper flat surface and the cover and a second volume between the lower flat surface and the cover are adjustable to obtain desired acoustic characteristics of the microphone.

17. The microphone of claim 16, wherein the slits of the cover have a first length and a second length, the first length being greater than the second length.

18. The microphone of claim 16, wherein the cover comprises a cylindrical rim configured to receive the cartridge and wherein the cylindrical rim is configured to be removable from the cartridge.

19. The microphone of claim 16, wherein the cover comprises a slit area and a cylindrical rim area and wherein the slit area is longer in an axial direction than the cylindrical rim area.

20. The microphone of claim 16, wherein the cover comprises a slit area and a cylindrical rim area and wherein the cylindrical rim area is of a similar length in an axial direction as the cylindrical rim area in the axial direction.

21. The microphone of claim 16, wherein the cover comprises acrylonitrile butadiene styrene.

22. A microphone kit comprising:

a cartridge; and a first cover and a second cover, both the first cover and the second cover comprising a cylindrical shape and a hemispherical end, a series of slits, the slits extending both radially and axially and curving radially inward, wherein the first cover and the second cover are configured to receive the cartridge and wherein the slits allow sound to pass through and wherein the slits have an axial length along a longitudinal axis of the first and second covers and have a radial length along a radius of the first and second covers and wherein a top surface of at least one of the slits continuously traverses a first portion of the cylindrical shape and a second portion of the hemispherical end, wherein the first cover comprises a cylindrical rim configured to receive the cartridge, wherein the cylindrical rim is configured to be removable from the cartridge, and wherein the first cover is replaceable with the second cover.

23. The microphone kit of claim 22, wherein the microphone kit further comprises a nest configured to be placed within the cartridge, the nest including a first diaphragm, a second diaphragm, and a printed circuit board (PCB) placed in a stacked arrangement, such that the PCB is positioned between the first diaphragm and the second diaphragm.

24. The microphone kit of claim 23, wherein the first diaphragm defines a first plane, the second diaphragm defines a second plane, and the PCB defines a third plane and wherein the first plane, the second plane, and the third plane extend substantially parallel to one another.

* * * * *